US006525638B2

(12) United States Patent
Oi

(10) Patent No.: US 6,525,638 B2
(45) Date of Patent: Feb. 25, 2003

(54) CHOKE COIL

(75) Inventor: Takaaki Oi, Takefu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/911,025

(22) Filed: Jul. 23, 2001

(65) Prior Publication Data

US 2002/0021201 A1 Feb. 21, 2002

(30) Foreign Application Priority Data

Jul. 21, 2000 (JP) ..... 2000-221401

(51) Int. Cl.[7] ..... H01F 27/24; H01F 27/29

(52) U.S. Cl. ..... 336/215; 336/83; 336/212; 336/233; 336/192

(58) Field of Search ..... 336/83, 192, 198, 336/212, 215, 233; 29/602.1; 313/440

(56) References Cited

FOREIGN PATENT DOCUMENTS

JP 11-238636 8/1999

*Primary Examiner*—Anh Mai
(74) *Attorney, Agent, or Firm*—Keating & Bennett, LLP

(57) ABSTRACT

A choke coil includes a magnetic bobbin, windings, and a magnetic connecting member. The bobbin has a winding member. End flange portions are provided at both ends of the winding member, and a center flange portion is provided at the approximate center thereof. The center flange portion preferably has a substantially rectangular shape and is slightly smaller than the end flange portions, and has inclined portions at two adjoining corners. The connecting member connects the outer peripheral portions of the end flange portions. A gap is formed between the connecting member and the outer peripheral surface of the center flange portion.

16 Claims, 7 Drawing Sheets

CHOKE COIL

BACKGROUND OF THE INVENTION

1. Field of the Invention

The present invention relates to a choke coil, and more particularly, to a choke coil for use in eliminating noise produced from electronic devices and for preventing noise entering electronic devices.

2. Description of the Related Art

This type of choke coil is disclosed in, for example, Japanese Unexamined Patent Application Publication No. 11-238636. FIG. 14 is a perspective view of an example of a choke coil. A choke coil 100 includes a magnetic bobbin 112, windings 126 and 128, and a magnetic connecting member 134. The magnetic bobbin 112 has a winding member that has a quadrangular prism shape. End flange portions 116 and 118 are provided at both ends of the winding member, and a center flange portion 120 is provided at the center thereof. The center flange portion 120 has a square shape and is slightly smaller than the end flange portions 116 and 118 (see FIG. 15).

The winding 126 is provided on the winding member between the end flange portion 116 and the center flange portion 120, and the winding 128 is provided on the winding member between the end flange portion 118 and the center flange portion 120. The plate-like magnetic connecting member 134 is placed on the outer peripheral surfaces of the end flange portions 116 and 118 so as to connect the outer peripheral portions thereof. On the other hand, a gap g is formed between the connecting member 134 and the outer peripheral surface of the center flange portion 120, as shown in FIG. 15.

In the above-described conventional choke coil 100, however, when a large normal-mode current is passed therethrough, a magnetic saturation phenomenon occurs, inductance is decreased, and an ability to eliminate normal-mode noise is reduced. In order to solve these problems, conventionally, the magnetic saturation phenomenon is suppressed and the normal-mode noise eliminating ability is maintained by increasing the sizes of the end flange portions 116 and 118 so that the connecting member 134 is spaced away from the center flange portion 120. However, this undesirably increases the height and overall size of the choke coil 100.

SUMMARY OF THE INVENTION

In order to overcome the problems described above, preferred embodiments of the present invention provide a low-profile choke coil in which a magnetic saturation phenomenon is minimized.

According to a preferred embodiment of the present invention, a choke coil includes a magnetic bobbin having a winding member, end flange portions disposed at both ends of the winding member, and a center flange-portion disposed at an approximate center of the winding member, a magnetic connecting member connecting the end flange portions at both ends of the winding member, the magnetic connecting member being spaced from the center flange portion by a distance, a first winding wire wound between the end flange portion at one end of the winding member and the center flange portion, and a second winding wire wound between the end flange portion at the other end of the winding member and the center flange portion, wherein at least one of a recessed portion and an inclined portion is provided at an edge of the center flange portion on the side of the connecting member so as to increase the magnetic resistance between the center flange portion and the connecting member.

By providing a recessed portion or an inclined portion at the edge of the center flange portion on the side of the connecting member, the magnetic resistance between the center flange portion and the connecting member is significantly increased. This allows the choke coil to minimize the magnetic saturation even when a large normal-mode noise current is passed therethrough.

Additional features, elements, characteristics and advantages of the present invention will become apparent from the following description of preferred embodiments with reference to the attached drawings.

DETAILED DESCRIPTION OF PREFERRED EMBODIMENTS

A choke coil according to a preferred embodiment of the present invention will be described below with reference to the attached drawings.

Figure 1:
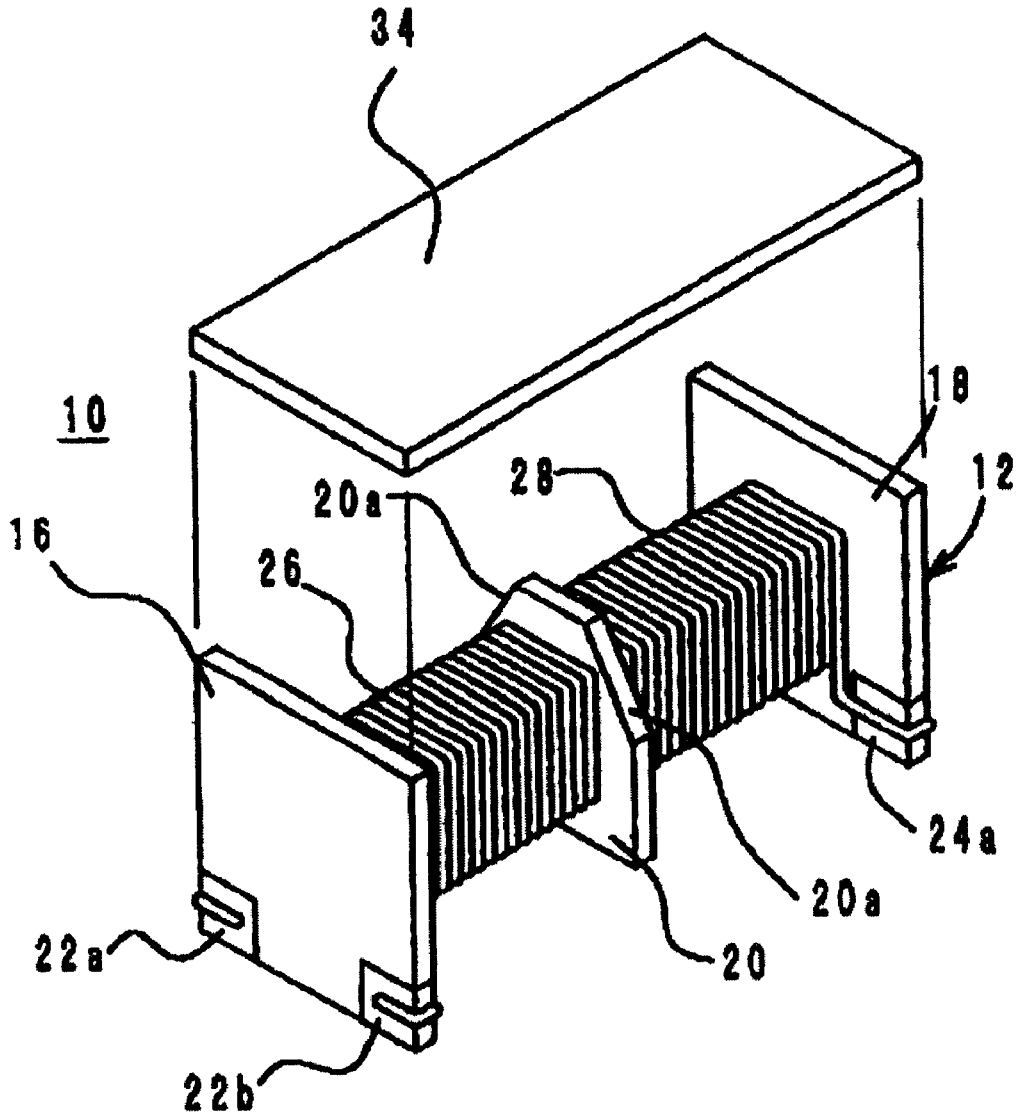
FIG. 1 is an exploded perspective view of a choke coil according to a preferred embodiment of the present invention.
Figure 2:
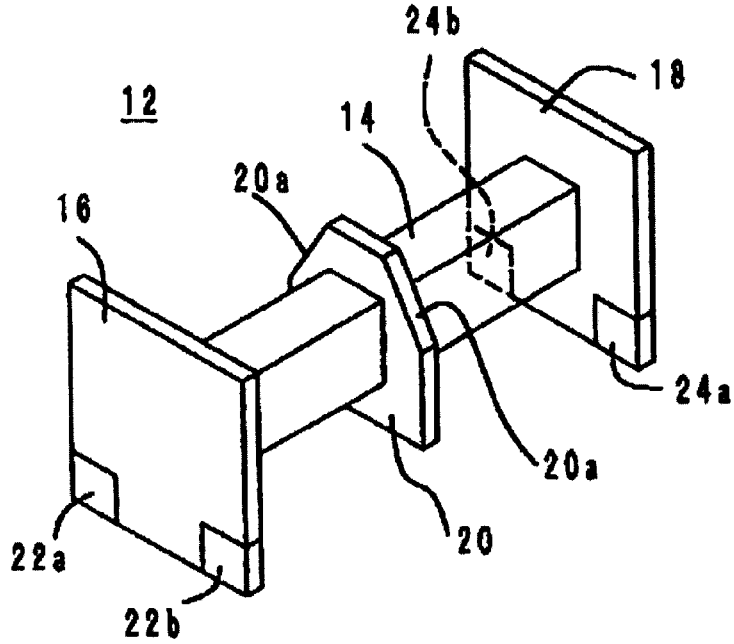
FIG. 2 is a perspective view of a magnetic bobbin used in the choke coil of FIG. 1.

FIG. 1 is an exploded perspective view of a choke coil 10 of the present preferred embodiment. The choke coil 10 preferably includes a magnetic bobbin 12, windings 26 and 28, and a magnetic connecting member 34. The magnetic bobbin 12 has a winding member 14 that preferably has a substantially quadrangular prism shape, as shown in FIG. 2. Substantially rectangular end flange portions 16 and 18 are provided at both ends of the winding member 14, and a center flange portion 20 is provided at an approximate center of the winding member 14. The center flange portion 20 preferably has a substantially rectangular shape and is preferably slightly smaller than the end flange portions 16 and 18, and has inclined portions 20*a* provided at two adjacent corners thereof. The inclined portions 20*a* are arranged such that a width d of the upper end of the center flange portion 20 is decreased and a height h of the inclined portions 20*a* is increased while the windings 26 and 28 do not protrude from the center flange portion 20, thereby increasing the magnetic resistance to a normal-mode noise current. Therefore, it is preferable that upper ends 29*a* of the inclined portions 20*a* be located inside of the side surfaces 26*a* of the winding 26 and that lower ends 29*b* of the inclined portions 20*a* be located below an upper surface 14*a* of the winding section 14 (see FIG. 5).

Electrodes 22*a* and 22*b* are provided at two corners of the end flange portion 16 so as to extend over both sides of the end flange portion 16. Electrodes 24*a* and 24*b* are provided at two corners of the end flange portion 18 so as to extend over both sides of the end flange portion 18. The electrode 22*a* and the electrode 24*b* are opposed to each other, and the electrode 22*b* and the electrode 24*a* are opposed to each other. The bobbin 12 is preferably made of a ferrite material, such as Ni-Zn or Mg-Zn, having a strong insulating ability, a magnetic resin containing the ferrite material, or other suitable material.

As shown in FIG. 1, the winding 26 is provided on the winding member 14 between the end flange portion 16 and the center flange portion 20. The two ends of the winding 26. are connected to the electrodes 22*a* and 22*b*, respectively. The winding 28 is provided on the winding member 14 between the end flange portion 18 and the center flange portion 20. The two ends of the winding 28 are connected to the electrodes 24*a* and 24*b* respectively. The winding 26 is arranged, for example, so as to be left-handed from the electrode 22*a* to the electrode 22*b*, as viewed from the side of the end flange portion 16. In this case, the winding 28 is arranged so as to be right-handed from the electrode 24*b* toward the electrode 24*a*, as viewed from the side of the end flange portion 18.

Figure 3:
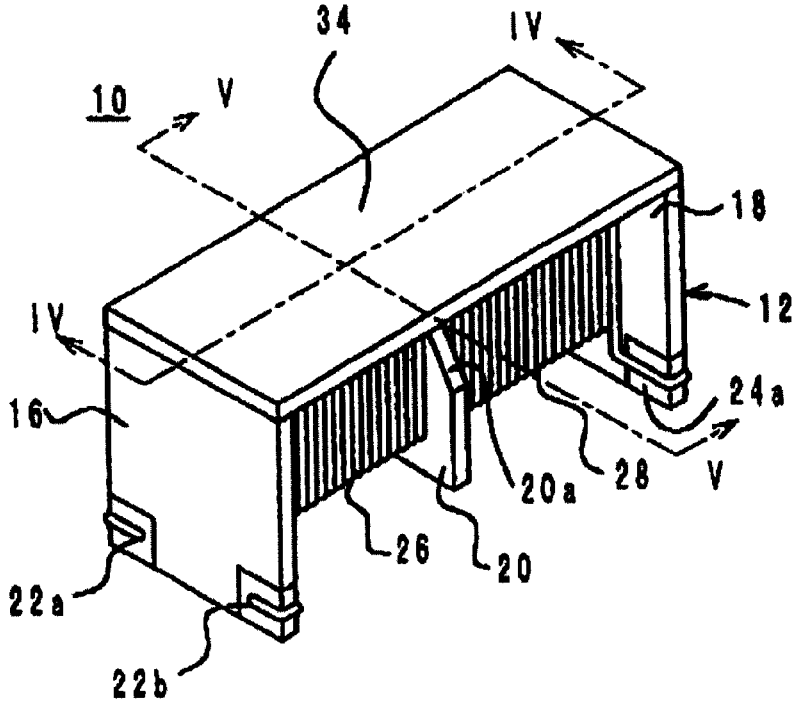
FIG. 3 is an external perspective view of the choke coil of FIG. 1.
Figure 4:
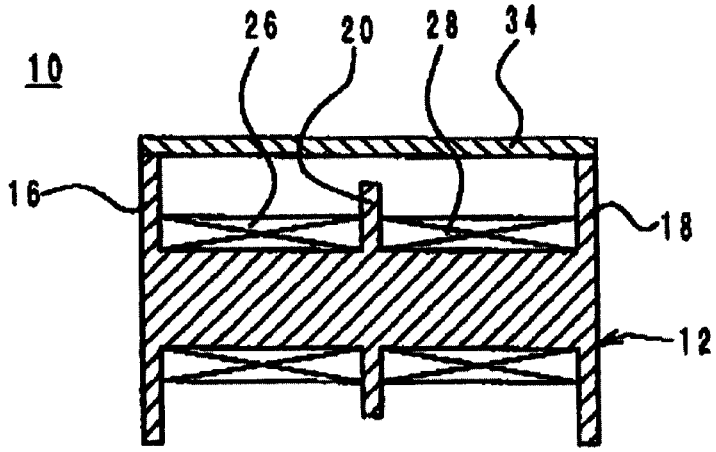
FIG. 4 is a cross-sectional view of the choke coil, taken along line IV—IV in FIG. 3.
Figure 5:
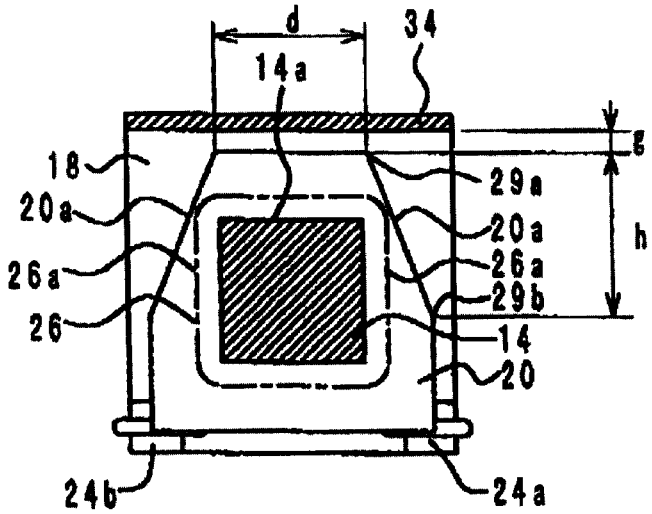
FIG. 5 is a cross-sectional view of the choke coil, taken along line V—V in FIG. 3.

Furthermore, the magnetic connecting member 34 that is preferably shaped like a plate is placed on the outer peripheral surfaces of the end flange portions 16 and 18 so as to connect the outer peripheral portions thereof, as shown in FIGS. 3 to 5. On the other hand, a gap g is provided between the connecting member 34 and the outer peripheral surface of the center flange portion 20.

Figure 6:
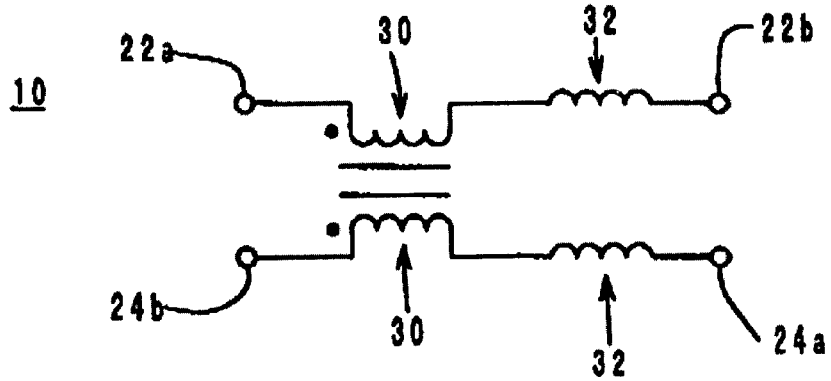
FIG. 6 is an electrical equivalent circuit diagram of the choke coil.

FIG. 6 is an electrical equivalent circuit diagram of the choke coil 10 with the above-described structure. In FIG. 6, reference numeral 30 denotes an inductance with respect to a common-mode current, and reference numeral 32 denotes an inductance with respect a normal-mode current.

Since the winding 26 and the winding 28 are separated at the center flange portion 20 in the choke coil 10, magnetic fluxes generated by the windings 26 and 28 will not overlap. For this reason, magnetic fluxes generated by a normal-mode current will not cancel each other, and an inductance can also be obtained for the normal mode current. Therefore, the choke coil 10 can remove not only common-mode noise but also normal-mode noise. Furthermore, since the windings 26 and 28 are separated, a high voltage-resistance can be obtained therebetween.

Elimination of the common mode noise and the normal mode noise by the choke coil 10 will be described in more detail.

Figure 7:
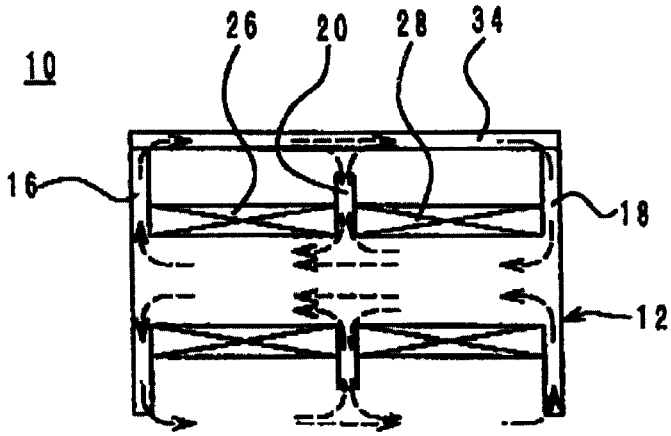
FIG. 7 is a magnetic circuit diagram showing elimination of common-mode noise by the choke coil.

When the choke coil 10 is used, for example, a signal source is connected to the electrodes 22*a* and 24*b*, and a load is connected to the electrodes 22*b* and 24*a*. A forward current is passed through the winding 26 and a reverse current is passed through the winding 28. When a common-mode noise current is applied, in-phase noise currents are passed through the windings 26 and 28. Magnetic fluxes are generated around the windings 26 and 28 by the noise currents. Since the magnetic fluxes cancel each other at the center flange portion 20, a magnetic flux which surrounds both the windings 26 and 28 can be obtained as a whole, as shown by the arrows in FIG. 7.

In this case, since the connecting member 34 connects the outer peripheral portion of the end flange portion 16 and the outer peripheral portion of the end flange portion 18, a closed magnetic circuit is defined by the bobbin 12 and the connecting member 34, the magnetic resistance to the magnetic flux generated by the common-mode noise current is minimized. Therefore, the inductance against the common-mode noise current is greatly increased. This makes it possible to increase the impedance against the common-mode noise current, and to thereby effectively eliminate the common-mode noise.

Figure 8:
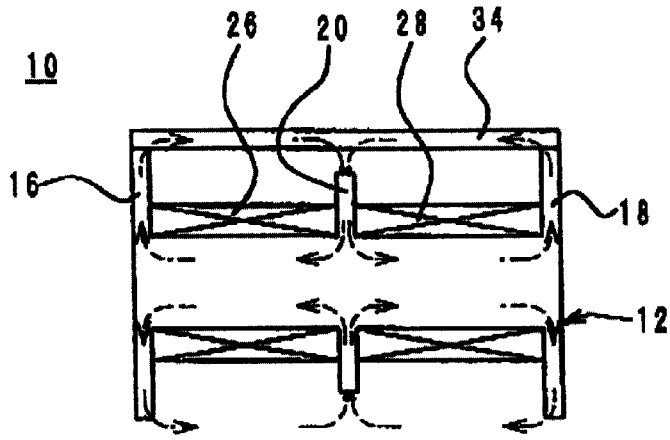
FIG. 8 is a magnetic circuit diagram showing elimination of normal-mode noise by the choke coil.

Magnetic fluxes generated by a normal-mode current do not cancel each other inside the bobbin 12, but are generated around the individual windings 26 and 28, as shown by the arrows in FIG. 8. That is, the magnetic fluxes flow out of the end flange portions 16 and 18 provided at both ends of the bobbin 12 and enter the center flange portion 20 along respective circulatory paths. In a section where the connecting member 34 defines a magnetic circuit, magnetic fluxes flow through the connecting member 34. Inductances are generated in the windings 26 and 28 by the magnetic fluxes, thereby eliminating the normal-mode noise.

In this case, since the center flange portion 20 has the inclined portions 20*a* on the side of the connecting member 34, as shown in FIG. 5, the effective dimension of the gap g increases and the magnetic resistance between the center flange portion 20 and the connecting member 34 increases. This allows the magnetic resistance to the normal-mode current to be increased without having to move the connecting member 34 away from the center flange portion 20. As a result, magnetic saturation is not prone to occur even when the choke coil is used in a place where large current passes, and the normal-mode noise is effectively eliminated.

Figure 9:
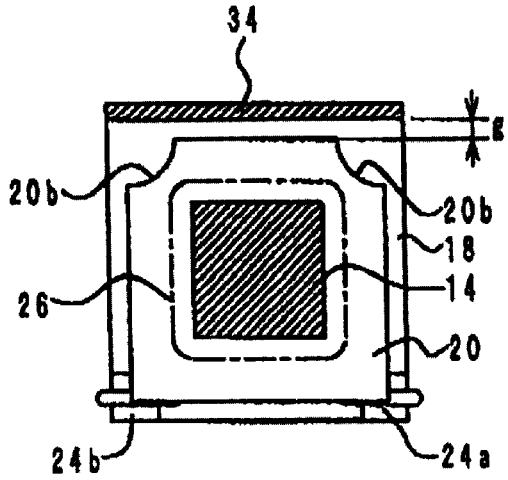
FIG. 9 is a cross-sectional view showing another preferred embodiment of the present invention.

The present invention is not limited to the above preferred embodiments, and various modifications are possible without departing from the scope of the invention. In particular, the shapes of the inclined portions and recessed portions provided in the center flange portion 20 may be determined arbitrarily. For example, as shown in FIG. 9, arc-shaped inclined portions 20*b* may be provided at two corners of the center flange portion 20.

Figure 10:
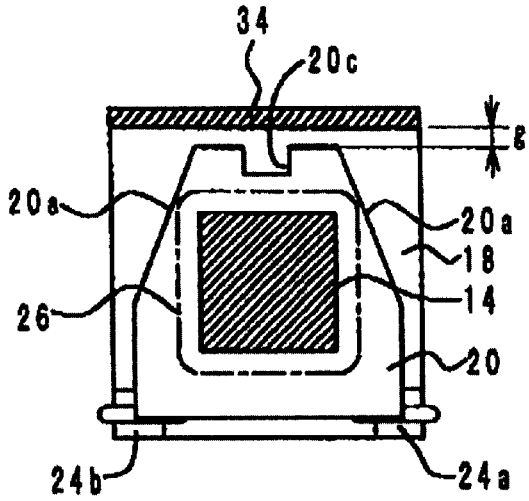
FIG. 10 is a cross-sectional view showing a further preferred embodiment of the present invention.
Figure 11:
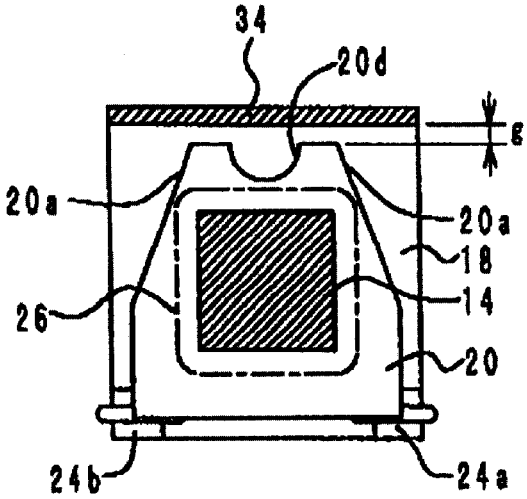
FIG. 11 is a cross-sectional view showing a further preferred embodiment of the present invention.

As shown in FIGS. 10 and 11, respectively, inclined portions 20*a* may be provided at two corners of the center flange portion 20, and a substantially rectangular recessed portion 20*c* or a semicircular recessed portion 20*d* may be provided at the center of one side of the center flange portion 20 on the side of the connecting member 34. This makes the magnetic resistance to a normal-mode noise current, which exists between the center flange portion 20 and the connecting member 34 shown in FIGS. 10 and 11, higher than that in FIG. 5.

Figure 12:
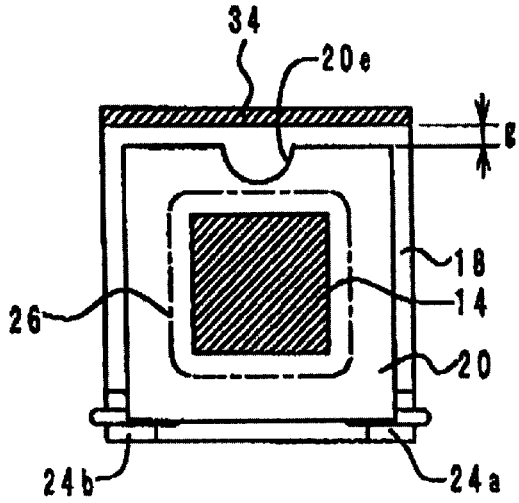
FIG. 12 is a cross-sectional view showing a further preferred embodiment of the present invention.
Figure 13:
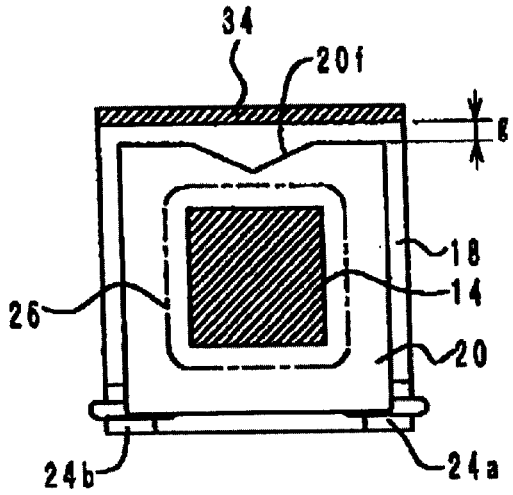
FIG. 13 is a cross-sectional view showing a further preferred embodiment of the present invention.
Figure 14:
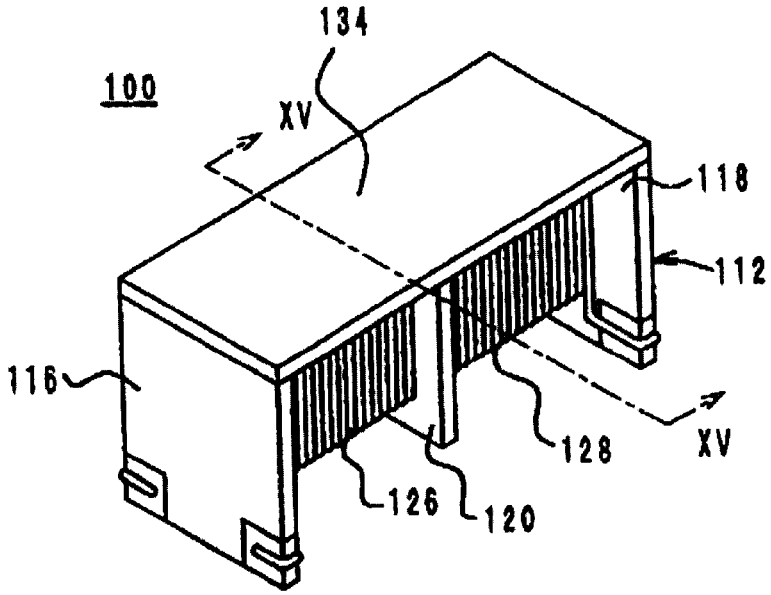
Fig.14 PRIOR ART
FIG. 14 is a perspective view of an example of a conventional choke coil.
Figure 15:
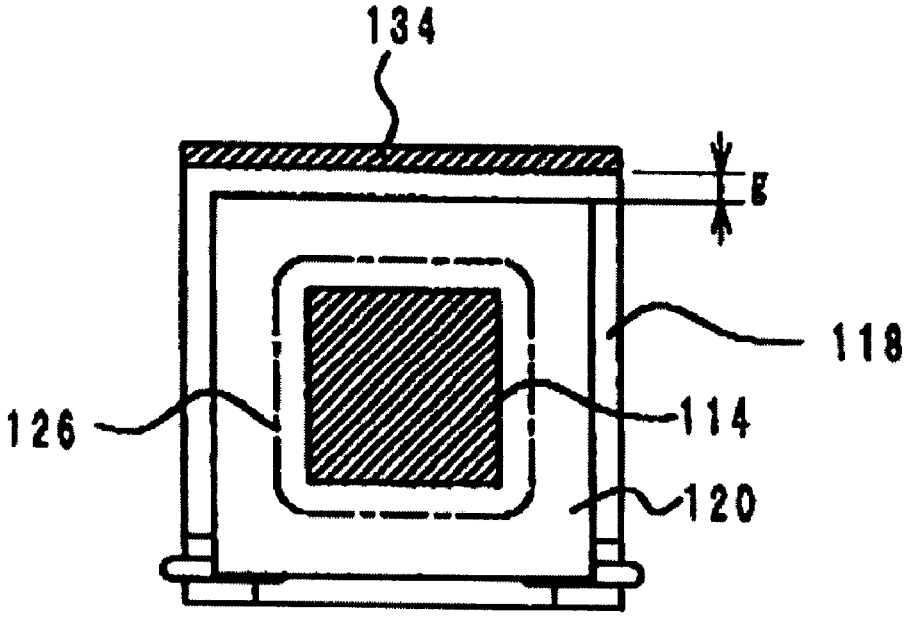
Fig.15 PRIOR ART
FIG. 15 is a cross-sectional view of the conventional choke coil, taken along line XV—XV in FIG. 14.

Alternatively, a substantially semicircular recessed portion 20*e* or a substantially triangular recessed portion 20*f* may be provided at the center of one side of the center flange portion 20 on the side of the connecting member 34, as shown in FIG. 12 or FIG. 13. The shape of the center flange portion 20 is not limited to those in the above preferred embodiments as long as the center flange portion 20 has a sufficient size to separate the windings 26 and 28 and has a desired magnetic resistance.

The connecting member 34 need not always be plate-like, but may be, for example, substantially cylindrical. In this case, the connecting member 34 is mounted so as to cover the entire windings 26 and 28. In this way, the shape of the connecting member 34 may be arbitrarily changed as long as the connecting member 34 can connect the end flange portions 16 and 18.

As described above, according to preferred embodiments of the present invention, since a gap is provided between the center flange portion of the winding member and the connecting member, and the center flange portion has a recessed portion or an inclined portion, it is possible to adjust the magnetic resistance to the magnetic flux generated by a large normal-mode current without having to move the connecting member away from the center flange portion, and to thereby prevent magnetic saturation. This also prevents the choke coil from being increased in size. In a case in which only a saturation characteristic equivalent to that of the conventional art is necessary, it is possible to reduce the gap between the center flange portion and the connecting member to achieve a lower-profile choke coil.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A choke coil comprising:

a magnetic bobbin having a winding member, end flange portions disposed at both ends of said winding member, and a center flange portion disposed at an approximate center of said winding member;

a magnetic connecting member connecting said end flange portions at both ends of said winding member, said magnetic connecting member being spaced from said center flange portion;

a first winding wire wound between said end flange portion at one end of said winding member and said center flange portion; and a second winding wire wound between said end flange portion at the other end of said winding member and said center flange portion; wherein at least one of a recessed portion and an inclined portion is provided at an edge of said center flange portion on the side of said connecting member so as to increase the magnetic resistance between said center flange portion and said connecting member.

2. A choke coil according to claim 1, wherein the winding member preferably has a substantially quadrangular prism shape.

3. A choke coil according to claim 1, wherein the end flange portions are substantially rectangular.

4. A choke coil according to claim 1, wherein the center flange portion has a substantially rectangular shape.

5. A choke coil according to claim 1, wherein the center flange portion is smaller than the end flange portions.

6. A choke coil according to claim 1, wherein the first and second winding wires do not protrude from the center flange portion.

7. A choke coil according to claim 1, wherein upper ends of the inclined portions are located inside of the side surfaces of the first winding and lower ends of the inclined portions are located below an upper surface of the winding member.

8. A choke coil according to claim 1, wherein electrodes are provided at two corners of each of the end flange portions so as to extend over both sides of the respective one of the end flange portions.

9. A choke coil according to claim 1, wherein the bobbin is made of a ferrite material and a magnetic resin containing the ferrite material.

10. A choke coil according to claim 8, wherein the first winding wire is arranged to be left-handed from a first one of the electrodes to a second one of the electrodes, and the second winding wire is arranged to be right-handed from a third one of the electrodes toward a fourth one of the electrodes.

11. A choke coil according to claim 1, wherein the magnetic connecting member is disposed on the outer peripheral surfaces of the end flange portions so as to connect the outer peripheral portions thereof.

12. A choke coil according to claim 1, wherein a gap g is provided between the magnetic connecting member and the outer peripheral surface of the center flange portion.

13. A choke coil according to claim 1, wherein arc-shaped inclined portions are provided at two corners of the center flange portion.

14. A choke coil according to claim 1, wherein inclined portions are provided at two corners of the center flange portion and one of a substantially rectangular recessed portion and a semicircular recessed portion 20*d* is provided at the center of one side of the center flange portion on the side of the magnetic connecting member.

15. A choke coil according to claim 1, wherein one of a substantially semicircular recessed portion and a substantially triangular recessed portion is provided at the center of one side of the center flange portion on the side of the magnetic connecting member.

16. A choke coil according to claim 1, wherein the magnetic connecting member is arranged to cover the entire first winding wire and the entire second winding wire.

* * * * *